US009132645B2

(12) United States Patent
Paschkewitz

(10) Patent No.: US 9,132,645 B2
(45) Date of Patent: Sep. 15, 2015

(54) PULSATING HEAT PIPE SPREADER FOR INK JET PRINTER

(71) Applicant: Palo Alto Research Center Incorporated, Palo Alto, CA (US)

(72) Inventor: John S. Paschkewitz, San Carlos, CA (US)

(73) Assignee: PALO ALTO RESEARCH CENTER INCORPORATED, Palo Alto, CA (US)

( * ) Notice: Subject to any disclaimer, the term of this patent is extended or adjusted under 35 U.S.C. 154(b) by 219 days.

(21) Appl. No.: 13/689,543

(22) Filed: Nov. 29, 2012

(65) Prior Publication Data

US 2014/0146116 A1 May 29, 2014

(51) Int. Cl.

| | |
|---|---|
| ***B41J 2/165*** | (2006.01) |
| ***B41J 2/175*** | (2006.01) |
| ***B41J 2/16*** | (2006.01) |
| ***B41J 2/14*** | (2006.01) |
| ***F28D 15/02*** | (2006.01) |
| *B41J 2/01* | (2006.01) |

(52) U.S. Cl.

CPC ..... *B41J 2/175* (2013.01); *B41J 2/14233* (2013.01); *B41J 2/1621* (2013.01); *B41J 2/17593* (2013.01); *F28D 15/0266* (2013.01); *B41J 2002/012* (2013.01); *B41J 2202/08* (2013.01); *B41J 2202/21* (2013.01); *Y10T 29/49353* (2015.01)

(58) Field of Classification Search

None

See application file for complete search history.

(56) References Cited

U.S. PATENT DOCUMENTS

| | | | |
|---|---|---|---|
| 4,921,041 | A | 5/1990 | Akachi |
| 5,272,491 | A | 12/1993 | Asakawa et al. |
| 5,402,160 | A | 3/1995 | Kadowaki et al. |
| 5,512,924 | A | 4/1996 | Takada et al. |
| 6,065,823 | A | 5/2000 | Kawamura |
| 2006/0290746 | A1 | 12/2006 | Kim |
| 2009/0141062 | A1 | 6/2009 | Takano et al. |
| 2010/0245506 | A1 | 9/2010 | Platt et al. |

FOREIGN PATENT DOCUMENTS

| | | |
|---|---|---|
| EP | 0440469 | 8/1991 |
| EP | 2484531 | 8/2012 |

OTHER PUBLICATIONS

Khandekar et al., "Closed and Open Loop Pulsating Heat Pipes", 13th International Heat Pipe Conference, Sep. 21-25, 2004, 14 pages.

European Search Report dated Feb. 18, 2014 from European Application No. 13195099.0, 6 pages.

*Primary Examiner* — Alejandro Valencia

(74) *Attorney, Agent, or Firm* — Hollingsworth Davis, LLC

(57) ABSTRACT

An inkjet printhead includes multiple inkjets arranged in a jetstack of the printhead. Each inkjet includes an inkjet nozzle and an actuator that controllably dispenses drops of a heat activated phase change ink according to a predetermined pattern. One or more heaters are arranged along the jetstack to heat the phase change ink to a temperature above the melting point of the ink. The printhead includes at least one pulsating heat pipe thermally coupled to the jetstack.

21 Claims, 8 Drawing Sheets

PULSATING HEAT PIPE SPREADER FOR INK JET PRINTER

TECHNICAL FIELD

This application relates generally to techniques that involve the use of a pulsating heat pipe to spread heat in an ink jet printhead. The application also relates to components, devices, systems, and methods pertaining to such techniques.

BACKGROUND

In general, inkjet printing machines or printers include at least one printhead that ejects drops or jets of liquid ink onto a recording or image forming media. A phase change ink jet printer employs phase change inks that are solid at ambient temperature, but transition to a liquid phase at an elevated temperature. The molten ink can then be ejected by a printhead directly onto an image receiving substrate, or indirectly onto an intermediate imaging member before the image is transferred to an image receiving substrate. Once the ejected ink is on the image receiving substrate, the ink droplets quickly solidify to form an image. It can be helpful to maintain a relatively constant temperature across the printhead during operation of the printer. Thermally conductive metallic plates have been used as heat spreaders for inkjet printheads.

SUMMARY

Embodiments disclosed herein involve the use of one or more pulsating heat pipe elements to spread heat across an inkjet printhead. An inkjet printhead includes multiple inkjets arranged in a jetstack of the inkjet printhead. Each inkjet includes an inkjet nozzle and an actuator, the inkjets and actuator configured to controllably dispense drops of a heat activated phase change ink according to a predetermined pattern. One or more heaters are arranged along the jetstack and are configured to heat the phase change ink to a temperature above the melting point of the ink. The printhead includes at least one pulsating heat pipe element thermally coupled to the jetstack.

In some implementations, the actuators comprise piezoelectric actuators.

The pulsating heat pipe may comprise a layered structure that includes at least one cover plate, a flow plate disposed adjacent to the cover plate, the flow plate comprising at least one serpentine flow channel and a heat carrying fluid disposed in the flow channel. In some implementations, the at least one cover plate includes first and second cover plates that are metallic and the flow plate is plastic and the plastic flow plate is sandwiched between the metal cover plates. In some implementations, the at least one cover plate and the flow plate are metal.

According to some aspects, the pulsating heat pipe extends below the jetstack to form an ink recycling gutter arranged to retrieve ink that drips from the inkjet nozzles. The at least one heater may be a resistive heater arranged lengthwise along a central region of the printhead. The pulsating heat pipe can include a heat pipe flow channel having upper and lower serpentine portions, wherein lower loops of the upper portion and upper loops of the lower portion are spaced apart longitudinally along the central region. The upper loops of the upper portion can be arranged near an upper edge of the jetstack and lower loops of the lower portion can extend into the ink recycling gutter. The heat carrying fluid disposed in the pulsating heat pipe may include one or both of water and alcohol.

Some embodiments are directed to a method of fabricating a printhead for an inkjet printer. A pulsating heat pipe is formed by enclosing at least one continuous channel formed in a flow plate with at least one cover plate to form a heat pipe flow channel. The heat pipe flow channel is filled with a heat carrying fluid, e.g., through a filling port that is sealed after the filling. A heater is disposed along an inkjet printer jetstack, the jetstack including inkjet nozzles and at least one electrically controllable piezoelectric actuator for each inkjet nozzle. The pulsating heat pipe is arranged to be thermally coupled to the jetstack.

In some implementations, a continuous channel is formed in a plastic flow plate and the plastic flow plate is enclosed by first and second cover plates. In some implementations, the first and second cover plates are made of bendable sheet metal. In some implementations, the cover plates and the flow plate are made of metal.

The pulsating heat pipe may be formed in a shape configured to operate as an ink recycling gutter for the printhead. In these implementations, arranging the pulsating heat pipe involves arranging the pulsating heat pipe adjacent and thermally coupled to the jetstack with the portion gutter positioned to catch ink that drips from the jetstack during operation of the printhead. Multiple loops of the pulsating heat pipe can be disposed in the ink recycling gutter portion.

Some embodiments are directed to a method of spreading heat in an inkjet printhead. Phase change ink in a printhead of an inkjet printer is heated above a melting temperature of the Ink using a heater arranged along the printhead. The heat from the heater is spread from warmer regions of the jetstack to cooler regions of the jet stack by successive vaporization and condensation of a heat carrying fluid disposed in a pulsating heat pipe. The actuators in the printhead are selectively activated to cause drops of the ink to be ejected through inkjet nozzles.

In some implementations, spreading the heat from the warmer regions to the cooler regions further comprises spreading the heat to a gutter arranged to catch ink that drips from the inkjet nozzles.

In some implementations, spreading the heat comprises spreading the heat in a direction orthogonal to an inkjet nozzle surface plate of the printhead.

The above summary is not intended to describe each embodiment or every implementation. A more complete understanding will become apparent and appreciated by referring to the following detailed description and claims in conjunction with the accompanying drawings.

DESCRIPTION OF THE DRAWINGS

Like reference numbers refer to like components; and

Drawings are not necessarily to scale unless otherwise indicated.

DESCRIPTION OF VARIOUS EMBODIMENTS

Ink jet printers operate by ejecting small droplets of liquid ink onto print media according to a predetermined pattern. The ink may be ejected directly on a final print media, such as paper, or may be first ejected on an intermediate print media, e.g. a print drum, before being transferred to the final print media. Some inkjet printers use phase-change ink that is solid at room temperature and is melted before being jetted onto the print media surface. Phase-change inks that are solid at room temperature advantageously allow the ink to be transported and loaded into the inkjet printer in solid form, without the packaging or cartridges typically used for liquid inks. In some implementations, the solid ink is melted in a page-width printhead which jets the molten ink in a page-width pattern onto the intermediate drum. The pattern on the intermediate drum is transferred onto paper through a pressure nip.

Solid ink printheads typically use multi-zone heaters or multiple wattage zone heaters, sometimes in combination with high thermal conductivity heat spreader layers in the printhead, to achieve a specified temperature uniformity in the printhead and/or acceptable temperatures in other components (for example, ink recirculation gutters). In practice, thermal conductivity requirements for the heat spreader layers of the printhead can be quite demanding, requiring thermal conductivity on the order of 300 W/m–k. These thermal conductivity requirements can be achieved using a copper plate, for example, however, copper or other metal spreaders having sufficient thermal conductivity can be relatively expensive to implement. Furthermore, multi-zone/multiple wattage heaters can add to the cost of the printhead.

Embodiments described in this disclosure involve the use of a pulsating heat pipe (PHP) as a heat spreader for a solid ink printhead. The use of a PHP as a heat spreader can reduce or eliminate the need for a copper plate or other thermal mass in the printhead having high thermal conductivity. Additionally or alternatively, implementation of a PHP as a printhead heat spreader can reduce the number of heaters (and/or the number of separate heat zones) used to heat the ink in the printhead to a few, e.g., one or two printhead heaters with the heat from the one or two heaters spread using the PHP. The PHP can be made with less expensive and/or lighter weight materials, when compared to copper or other high thermal conductivity materials, for example. Additionally, the PHP is amenable to fabrication using a layered structure compatible with printhead manufacturing processes.

Figure 1A:
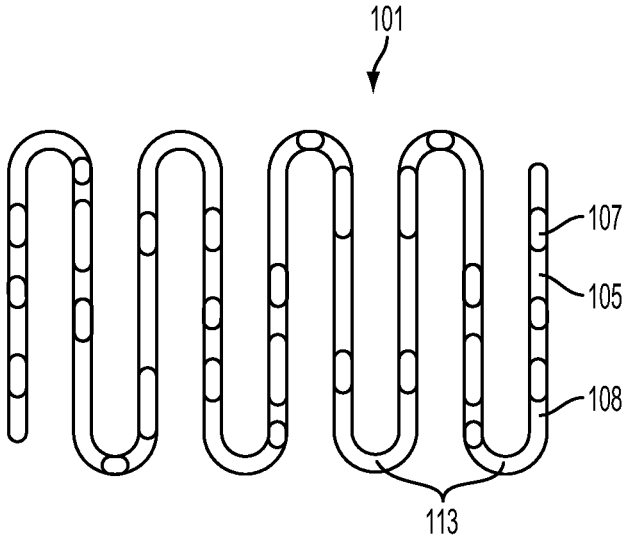
FIGS. 1A and 1B illustrate an open loop and a closed loop pulsating heat pipe (PHP), respectively.
Figure 1B:
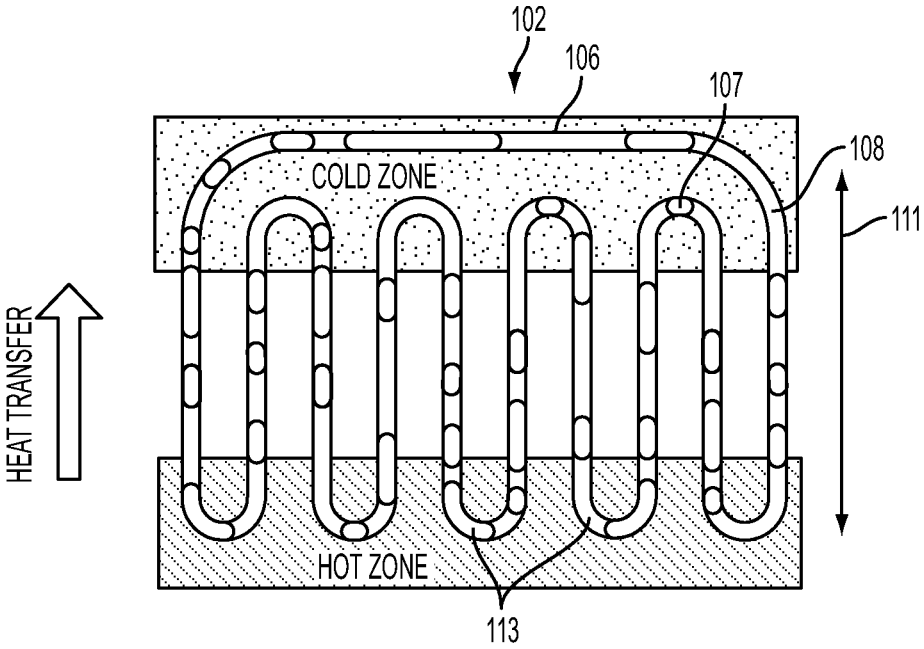

As illustrated in FIGS. 1A and 1B, PHPs may comprise a serpentine tube or channel 105, 106 having a number of turns, e.g., U-turns 113. Unlike some conventional heat pipes, there need not be an additional capillary structure inside the PHP tube 105, 106. FIG. 1A shows an open loop PHP 101, wherein each end of the PHP tube 105 is sealed. FIG. 1B shows a closed loop PHP 102, wherein the PHP tube 106 is joined end to end. Either of these configurations can be used as an inkjet printhead PHP spreader.

The PHP 101, 102 is formed by evacuating and partially filling the tube 105, 106 with a heat carrying liquid. The liquid and vapor in the tube 105, 106 arrange themselves as a series of vapor bubbles 107 and liquid slugs 108. As illustrated in FIG. 1B, the PHP 102 is arranged so that some of U-turns are in a hot temperature zone and some of the U-turns are in a cold temperature zone. The heat carrying fluid vaporizes in the hot zone and condenses in the cold zone. The volume expansion due to the vaporization and contraction due to condensation causes an the liquid slugs and bubbles to oscillate 111 which transfers heat from the hot zone to the cold zone by a pulsating action of the liquid-vapor within the tube 105, 106.

Figure 2A:
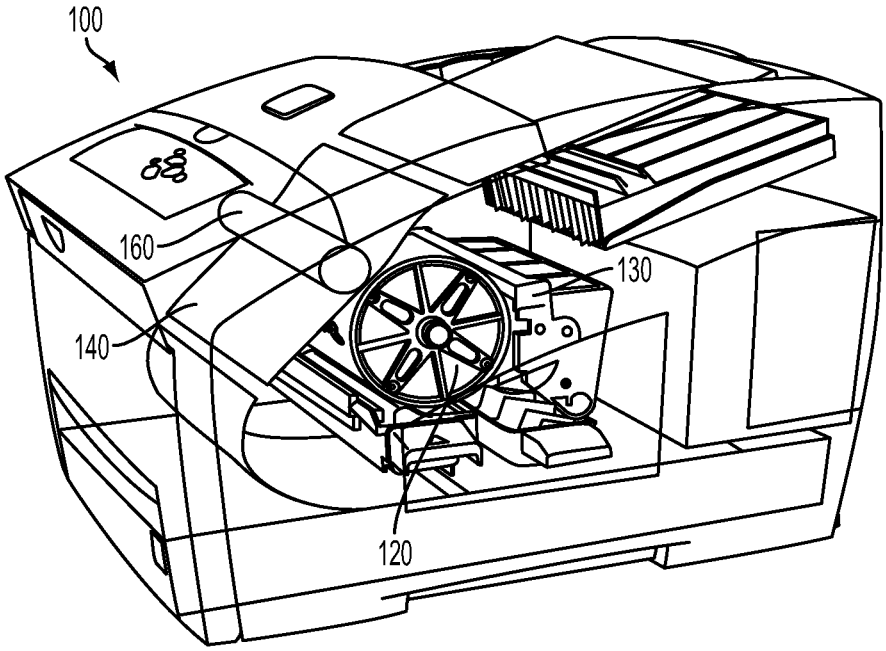
FIGS. 2A and 2B depict views of an inkjet printer incorporating a printhead with a PHP spreader according to embodiments disclosed herein.
Figure 2B:
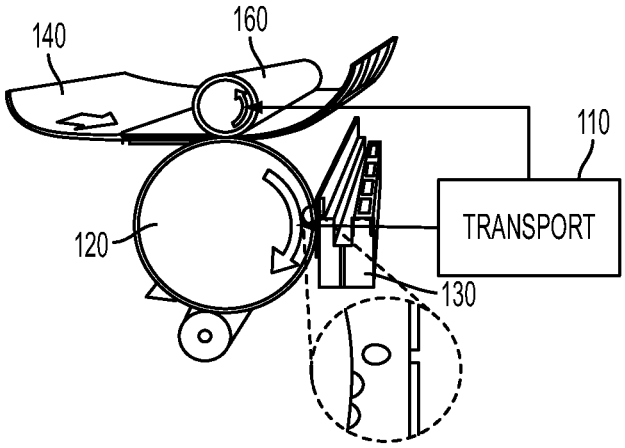

Embodiments discussed herein involve the use of a PHP as a heat spreader for an ink jet printer. FIGS. 2A and 2B provide internal views of portions of an ink jet printer 100 that incorporates a PHP as discussed herein. The printer 100 includes a transport mechanism 110 that is configured to move the drum 120 relative to the print head 130 and to move the paper 140 relative to the drum 120. The print head 130 may extend fully or partially along the length of the drum 120 and includes a number of ink jets. As the drum 120 is rotated by the transport mechanism 110, ink jets of the print head 130 deposit droplets of ink though ink jet apertures onto the drum 120 in the desired pattern. As the paper 140 travels around the drum 120, the pattern of ink on the drum 120 is transferred to the paper 140 through a pressure nip 160.

Figure 3:
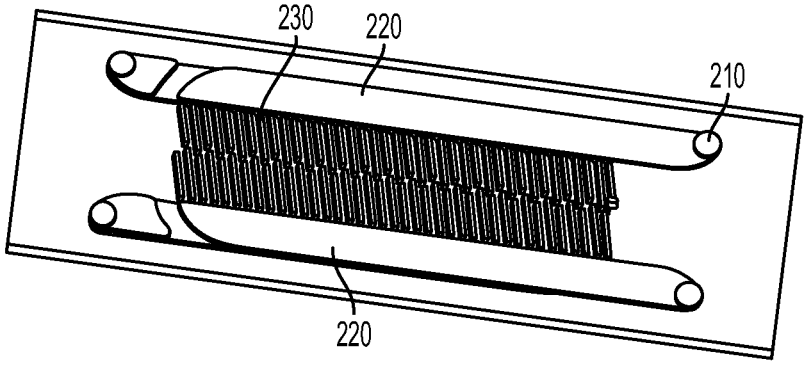
FIGS. 3 and 4 show views of an exemplary print head of the ink jet printer of FIG. 2A.
Figure 4:
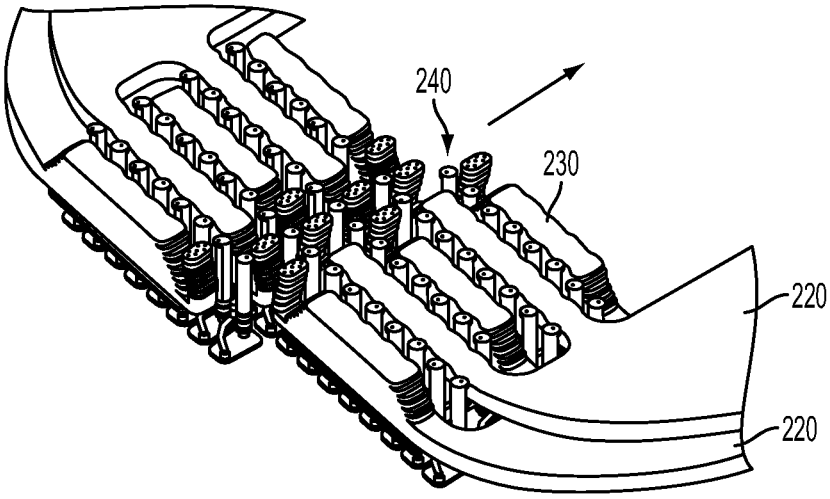

FIGS. 3 and 4 show more detailed views of an exemplary printhead. The path of molten ink, contained initially in a reservoir, flows through a port 210 into a main manifold 220 of the printhead. As best seen in FIG. 4, in some cases, there are four main manifolds 220 which are overlaid, one manifold 220 per ink color, and each of these manifolds 220 connects to interwoven finger manifolds 230. The ink passes through the finger manifolds 230 and then into the inkjets 240. The manifold and inkjet geometry illustrated in FIG. 4 is repeated in the direction of the arrow to achieve a desired print head length, e.g. the full width of the drum.

Figure 5:
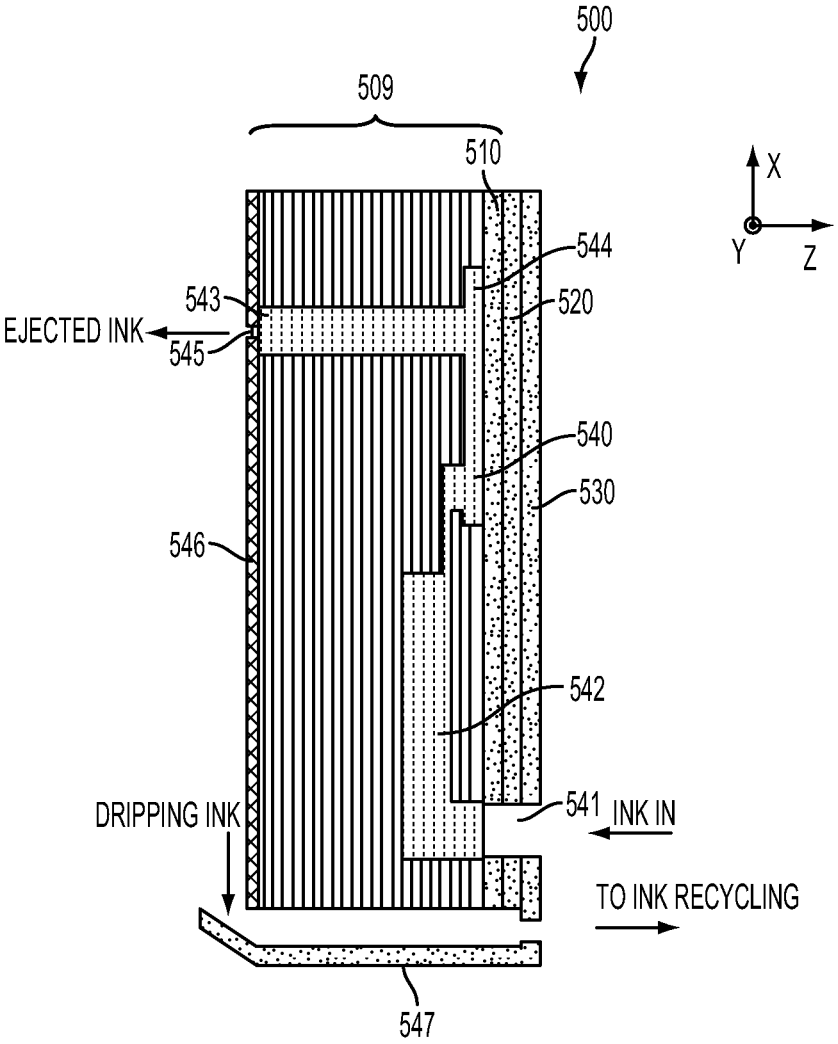
FIG. 5 provides a cross sectional view of a printhead using a PHP spreader in accordance with some embodiments.

FIG. 5 provides a more detailed view of layered printhead 500 that includes a PHP spreader layer 510. In this example, the printhead 500 uses piezoelectric transducers (PZTs) arranged in a piezoelectric (PZT) actuator layer 520. The PZT actuator layer contains bonding media and electrical connections that connect to the heater/electrical flex layer 530. The PZTs are controlled to eject ink droplets toward the final or intermediate print medium, although other methods of ink droplet ejection are known. Printers using a variety of ink ejection technologies may use a PHP heat spreader as described herein. Ink enters the printhead jetstack 509 from inlet 541 and travels through the printhead manifold 542 and finger manifold 540 to the jet nozzle 543. Activation of the PZT (located in the PZT actuator layer 520) associated with the nozzle 543 causes a pumping action that alternatively draws ink into the ink jet body 544 and expels the ink through ink jet nozzle 543 and out of the aperture 545 in the surface plate 546 of the printhead.

Prior to jetting the ink, the phase change ink is melted using one or more heaters disposed along the ink flow path in the printer, including one or more heaters disposed in heater layer 530 of the printhead. In some implementations, a printhead heater can include a one or more resistive heating elements disposed in the heater layer 530. In some implementations, a single heater may be used. The heater may extend lengthwise along a majority (50% or more) of the length of the print head. Depending on the configuration of the printhead and the heaters, the print head heating may cause temperature variation across the printhead. Embodiments described herein use a PHP to spread heat across the printhead from relatively warmer regions to relatively cooler regions and to achieve sufficiently uniform heating across longitudinal and/or lateral dimensions of the printhead, i.e., along the x-y plane in FIG. 5. In some embodiments, a PHP is used to spread heat along an ink flow path away from or toward the printhead, i.e., in the z direction, having a component that is perpendicular to the surface plate 546.

The phase change ink can undergo a number of freeze-thaw cycles. For example, the printer may be turned off when not in use causing the ink in the printer to freeze. Upon power-up, the ink is melted before ink jetting occurs. Pockets of air can form along the ink flow path during the freeze-thaw cycles, resulting in bubbles in the melted ink. The air bubbles may cause undesirable printing defects. In some configurations, e.g., after power-up and before printing occurs, the ink flow path may be purged of air, which involves expelling a portion of the ink from the inkjets along with the air bubbles present in the ink. During purging, ink is expelled from the ink jet aperture 545 onto the surface plate 546. The expelled ink can be recycled. In some arrangements, the expelled ink is allowed to drip from the surface plate into an ink recycling gutter 547 that catches the ink for recycling. The ink in the gutter is recycled back into the ink flow path to eventually be ejected onto the print media. In operation, the components of the printhead 500 that contact the ink, including portions of the jetstack as well as the gutter, need to be maintained at a temperature above the ink melting point. Maintaining this high temperature is generally challenging due to the high thermal losses off the gutter, requiring the use of an additional heater and controller, adding cost and complexity. The PHPs described herein can be configured to spread heat from hotter portions of the printhead nearer the heaters to colder portions of the printhead, such as the gutter. The one or more printhead heaters used in combination with one or more PHPs can maintain the temperature of the ink above the ink melting point and achieve sufficient temperature uniformity to allow consistent jetting from the inkjets and to allow ink recycling without a significant amount of ink freezing in the gutter thereby eliminating the need for an extra heater and controller in some implementations.

Figure 6A:
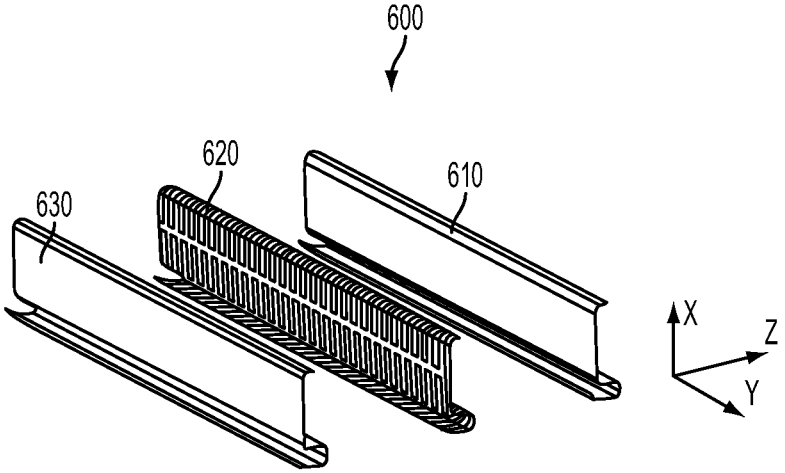
FIGS. 6A and 6B show the layered structure of a PHP spreader in accordance with embodiments discussed herein.
Figure 6B:
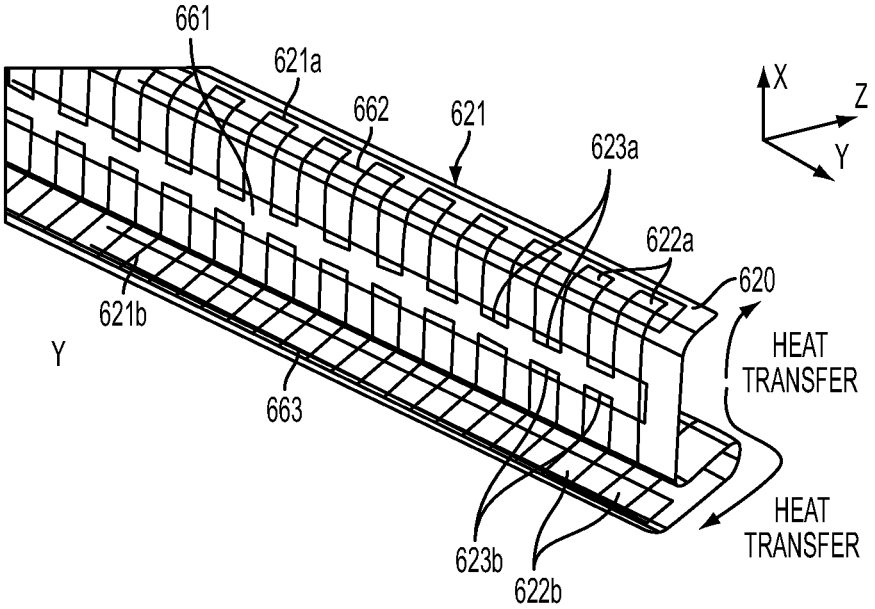

FIG. 6A shows one implementation of a layered PHP 600 that can be implemented as the PHP layer 510 shown in FIG. 5. In this example, the PHP 600 includes three sublayers comprising first and second cover plates 610, 630, and a flow plate 620. As shown in FIG. 6B, the flow plate 620 can comprise a double serpentine channel 621 that may be open loop or closed loop as previously discussed. When cover plates on both sides of the flow plate are used, the flow channel may extend all the way through the flow plate. The flow plate is sandwiched between the cover plates, sealing the channel between the cover plates. However, some layered arrangements use only a cover plate on one side, wherein the flow channel extends only partially through the flow plate. In this arrangement sealing, on only one side of the flow channel is required, which is accomplished by the cover plate disposed on one side of the flow plate.

When disposed in the printhead as PHP layer 510, the flow plate 620 and first and second cover plates 610, 630 are arranged as a stack, with the first and second cover plates 610, 630 enclosing the serpentine channel 621. The serpentine channel 621 is evacuated and then partially filled with a heat carrying fluid, forming the PHP. The double serpentine channel 621 has first and second serpentine portions 621*a*, 621*b*. Each serpentine portion 621*a*, 621*b* includes U-turns 623*a*, 623*b* in a hot zone 661 of the printhead, and U-turns 622*a* , 622b in a cold portion 662, 663 of the printhead. In the example of FIG. 6B, the hot portion 661 is located along the middle region of the PHP. In this example, a first cold portion 662 is located at the top region of the printhead and a second cold portion 663 is located in the gutter region of the printhead. In this configuration, the PHP spreads heat from the middle portion to the upper regions and gutter regions of the printhead. In some cases, the layers of the PHP, e.g., cover plate(s) and flow plate, form the gutter of the printhead, as shown in FIG. 6A.

The arrangement shown in FIGS. 6A and 6B is useful when the printhead heater is located longitudinally along the printhead and warms the central region of the printhead. The PHP arrangement shown in FIGS. 6A and 6B spreads heat laterally (along the x direction) to the upper portion of the printhead. The PHP also spreads heat laterally along the x direction to the gutter and then along the z direction within the gutter. However, other arrangements of the PHP are possible and the flow channel could be rearranged to include heat spreading longitudinally along the printhead (along the y direction) or along the z direction away from or to the printhead, i.e., along a direction perpendicular to the surface plate of the jetstack. In some embodiments, multiple PHPs could be used. For example, the flow channels could be formed so that multiple, separate channels for separate PHPs are disposed a flow plate. Furthermore, although the example shown in FIGS. 6A and 6B shows a double serpentine channel, the channel may be formed with more or fewer serpentine portions. For example, the flow channel may only include a single serpentine portion that spreads heat from the region of the heater to the gutter portion.

Figure 7:
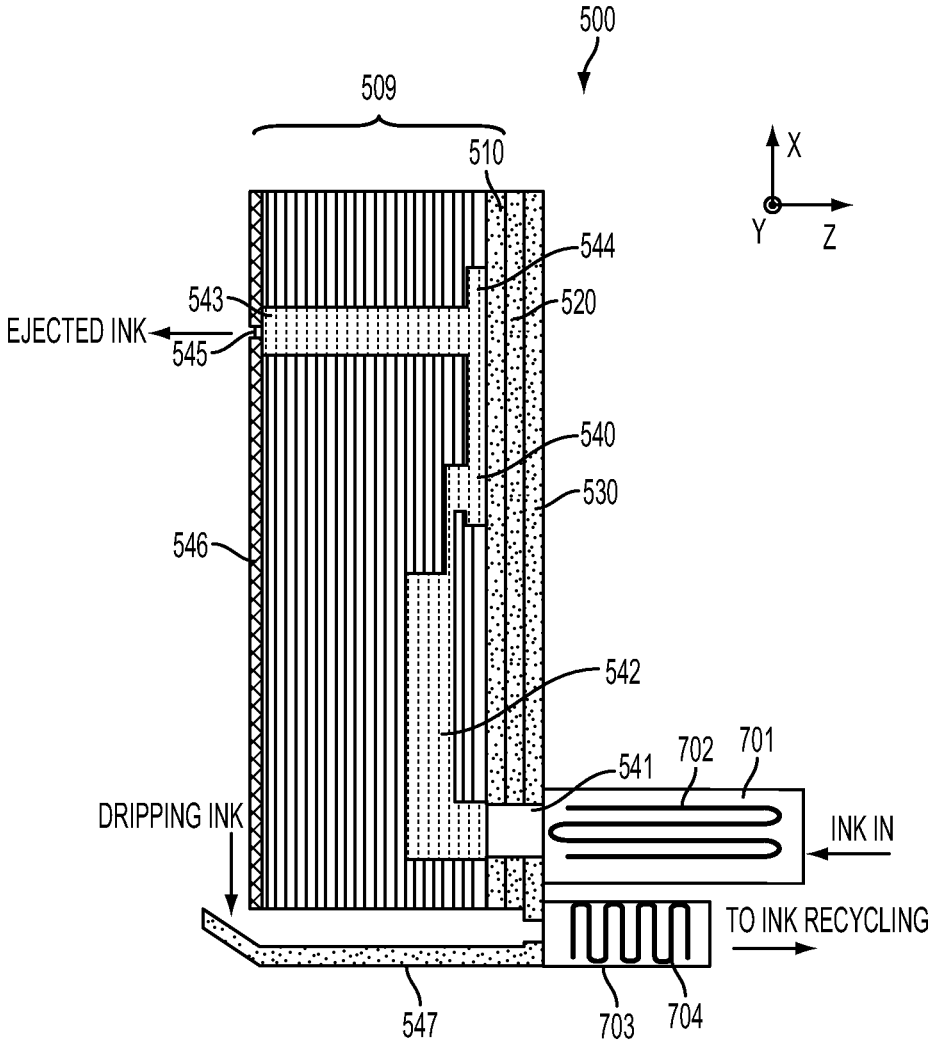
FIG. 7 shows some optional orientations for PHPs in relation to an inkjet printhead.

FIG. 7 is similar in some respects to FIG. 5, but also shows alternate locations for one or more PHPs that spread heat along a flow path connecting to the printhead. FIG. 7 shows ink flow path 701 that supplies ink to the print head. Ink flow path 701 includes PHP 702 configured to transfer heat along the z direction of the flow path away from or to the printhead, e.g., orthogonal to the plane of the ink jet nozzle surface plate 546. Ink flow path 703 carries recycled ink away from the printhead and includes PHP 704. PHP 704 is arranged to spread heat laterally along the x direction of the flow path 703 which extends along the z direction. In alternative embodiments, PHP 702 may be arranged to spread heat laterally and PHP 704 may be arranged to spread heat along the z direction away from or toward the printhead.

In some embodiments, the at least one cover plate and the flow plate of the PHP comprise a plastic material. In some embodiments, at least one of the cover plates are formed of metal, or a metal alloy such as copper, nickel, stainless steel, anodized aluminum, or any other type of sheet metal. The flow plate may also metallic, or, to reduce weight and cost, the flow plate and/or the cover plate(s) may be plastic. The heat carrying fluid in the flow channels of the PHP can include any heat carrying fluid suitable for temperatures of phase change ink, such as water and/or alcohol. Thermally conductive materials may be used since the overall performance of the PHP (defined as an effective conductivity) can be diminished if lower conductivity plastics or metals are used.

Figure 8:
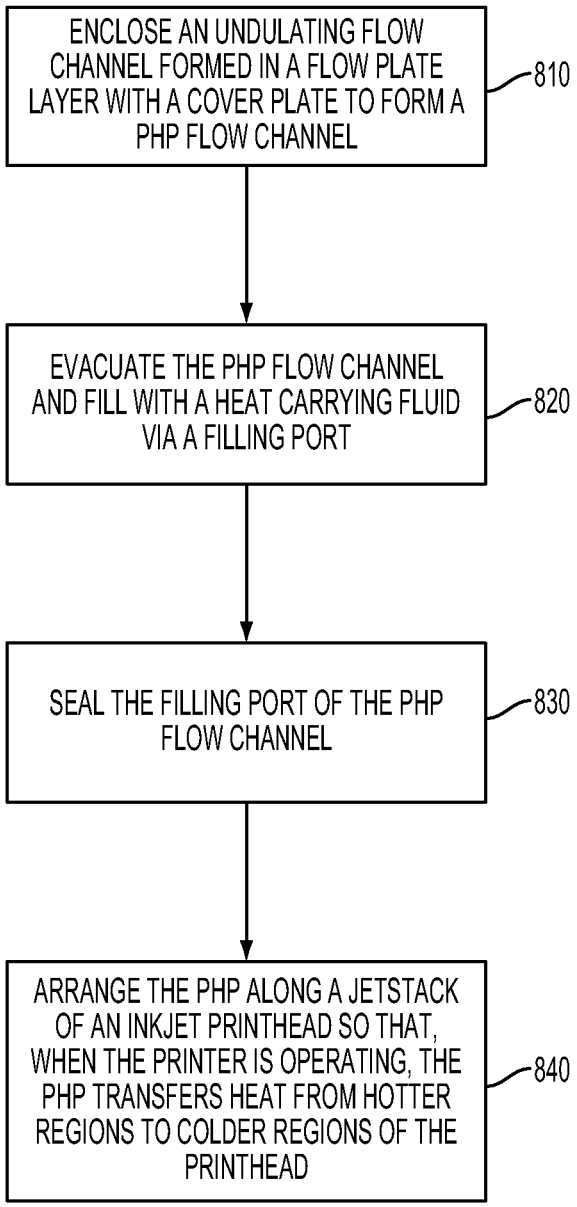
FIG. 8 is a flow diagram of a process for fabricating a printhead having a PHP spreader.

FIG. 8 is a flow graph illustrating a method of fabricating a printhead that includes a layered PHP in accordance with some embodiments. The process includes enclosing 810 at least one undulating, e.g., serpentine, flow channel disposed on a flow plate using a cover plate to form an enclosed PHP channel. As previously discussed, the flow plate and/or the cover plate may comprise metal and/or plastic. The PHP channel is evacuated and partially filled 820 with a heat carrying fluid through a filling port. The heat carrying fluid may include water or alcohol, for example. The filling port can be sealed 830 by any means, such as soldering, crimping, brazing, welding, etc. The layered PHP is arranged along a jet stack of an inkjet printer printhead. The arrangement of the PHP is such that the PHP transfers heat from hotter regions of the printhead to colder regions of the printhead to enhance uniformity of the heating across the printhead.

In some cases, one or more heaters may be arranged to heat the jetstack and/or other portions of the printhead. The PHP is arranged to spread heat from regions near the one or more heaters to regions that are more remote from the heaters. In some embodiments, the layered PHP may extend to the gutter. In some embodiments, the layers of the layered PHP may form or at least partially form the gutter. The PHP may be arranged to transfer heat from a hotter region to the gutter, and the heat transfer can serve to prevent at least some ink that drips from the inkjet nozzles into the gutter from freezing.

Figure 9:
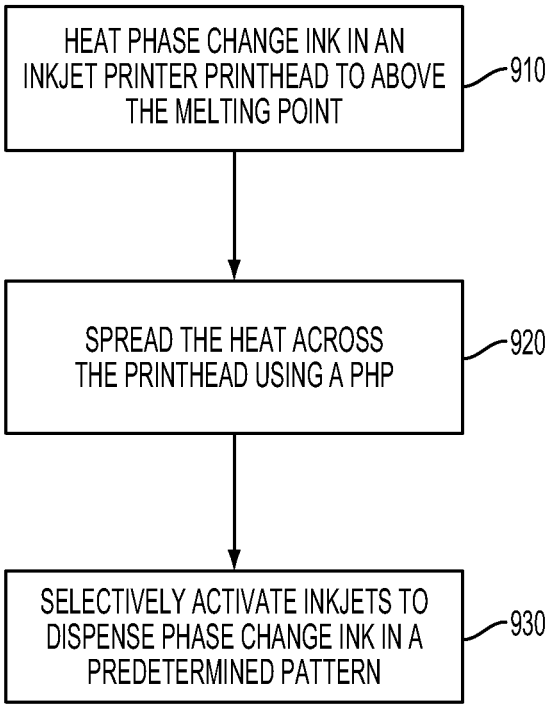
FIG. 9 is a flow diagram of a method of spreading heat in an inkjet printer printhead using a PHP spreader.

FIG. 9 is a flow diagram that illustrates a method of using a PHP to enhance uniformity of heating in an inkjet printer printhead. The method includes heating 910 phase change ink in a jetstack of an inkjet printer printhead above a melting temperature of the ink using a heater arranged along the jetstack. During operation of the printer, heat generated by the heater is spread 920 from hotter regions of the printhead to colder regions using a PHP, the PHP operating by successive vaporization and condensation of a heat carrying fluid disposed in a pulsating heat pipe. Actuators in the jetstack are then selectively activated 930 to cause drops of the ink to be ejected through inkjet nozzles in a predetermined pattern. In some cases, only a single heater is employed to heat the printhead, and in some cases multiple separately controllable heaters may be used. The printhead can include a gutter and spreading the heat from the hotter regions to the colder regions can involve spreading heat from a hotter region to the gutter. Spreading heat to the ink recycling gutter may help to prevent ink dripping into the gutter from freezing.

Various modifications and additions can be made to the preferred embodiments discussed above. Systems, devices or methods disclosed herein may include one or more of the features, structures, methods, or combinations thereof described herein. For example, a device or method may be implemented to include one or more of the features and/or processes described below. It is intended that such device or method need not include all of the features and/or processes described herein, but may be implemented to include selected features and/or processes that provide useful structures and/or functionality.

What is claimed is:

1. An inkjet printhead, comprising:

multiple inkjets arranged in a jetstack of the inkjet printhead, each inkjet including an inkjet nozzle and an actuator, the inkjets and actuator configured to controllably dispense drops of a heat activated phase change ink according to a predetermined pattern;

one or more heaters arranged along the jetstack and configured to heat the phase change ink to a temperature above the melting point of the ink; and at least one pulsating heat pipe thermally coupled to the jetstack.

2. The inkjet printhead of claim 1, wherein the pulsating heat pipe extends below the jetstack to form a gutter arranged to retrieve ink that drips from the inkjet nozzles.

3. The inkjet printhead of claim 2, wherein the pulsating heat pipe comprises:

a layered structure that includes:

at least one cover plate;

a flow plate disposed adjacent to the cover plate, the flow plate comprising at least one serpentine flow channel; and a heat carrying fluid disposed in the flow channel.

4. The inkjet printhead of claim 3, wherein the at least one cover plate includes first and second cover plates that are metallic and the flow plate is plastic and the plastic flow plate is sandwiched between the metal cover plates.

5. The inkjet printhead of claim 3, wherein the at least one cover plate and the flow plate are metal.

6. The inkjet printhead of claim 2, wherein the actuators comprise piezoelectric actuators.

7. The inkjet printhead of claim 2, wherein the one or more heaters comprise a resistive heater arranged lengthwise along a central region of the printhead.

8. The inkjet printhead of claim 7, wherein the pulsating heat pipe includes a heat pipe flow channel having upper and lower serpentine portions wherein lower loops of the upper portion and upper loops of the lower portion are spaced apart longitudinally along the central region.

9. The inkjet printhead of claim 8, wherein upper loops of the upper portion are arranged near an upper edge of the jetstack and lower loops of the lower portion extend into the gutter.

10. The device of claim 2, wherein a heat carrying fluid disposed in the pulsating heat pipe comprises one or both of water and alcohol.

11. A method of fabricating a printhead for an inkjet printer, comprising:

forming a pulsating heat pipe, comprising:

enclosing at least one continuous channel formed in a flow plate with at least one cover plate to form a heat pipe flow channel with a filling port;

filling the heat pipe flow channel with a heat carrying fluid though the filling port; and sealing the filling port;

disposing a heater along an inkjet printer jetstack, the jetstack including inkjet nozzles and at least one electrically controllable piezoelectric actuator for each inkjet nozzle; and arranging the pulsating heat pipe to be thermally coupled to the jetstack.

12. The fabrication method of claim 11, wherein sealing the filling port comprises sealing by one or more of brazing and crimping.

13. The fabrication method of claim 11, wherein:

forming the pulsating heat pipe comprises:

forming the continuous channel in a plastic flow plate; and enclosing the plastic flow plate with first and second cover plates, wherein at least one of the first and second cover plates are made of bendable sheet metal.

14. The fabrication method of claim 11, wherein the pulsating heat pipe is formed in a shape configured to operate as an ink recycling gutter for the printhead.

15. The fabrication method of claim 11, wherein:

the pulsating heat pipe includes an ink recycling gutter portion; and arranging the pulsating heat pipe adjacent to be thermally coupled to the jetstack comprises arranging the portion gutter to catch ink that drips from the jetstack during operation of the printhead.

16. The fabrication method of claim 15, wherein the heat pipe flow channel includes multiple loops disposed in the ink recycling gutter portion.

17. The fabrication method of claim 11, wherein the heater comprises a resistive heater arranged lengthwise along a majority of a length of the jetstack.

18. A method, comprising:

heating phase change ink in a printhead of an inkjet printer above a melting temperature of the ink using a heater arranged along the printhead;

selectively activating actuators in the printhead to cause drops of the ink to be ejected through inkjet nozzles; and spreading heat generated by the heater from warmer regions of the jetstack to cooler regions of the jet stack by successive vaporization and condensation of a heat carrying fluid disposed in a pulsating heat pipe.

19. The method of claim 18, wherein heating the ink comprises heating the ink using a single resistive heater arranged lengthwise along a majority of a length of the printhead.

20. The method of claim 18, wherein spreading the heat from the warmer regions to the cooler regions further comprises spreading the heat to an ink recycling gutter arranged to catch ink that drips from the inkjet nozzles.

21. The method of claim 18, wherein spreading the heat comprises spreading the heat in a direction orthogonal to an inkjet nozzle surface plate of the printhead.

* * * * *